United States Patent [19]

Wells et al.

[11] Patent Number: 4,486,732

[45] Date of Patent: Dec. 4, 1984

[54] AMBIENT COMPENSATED MOTOR PROTECTOR

[76] Inventors: Robert M. Wells, 4371 Ira Rd., Akron, Ohio 44313; Alton R. Wells, 4573 W. Trade Winds Ave., Lauderdale-by-the-Sea, Fla. 33308

[21] Appl. No.: 411,855

[22] Filed: Aug. 26, 1982

[51] Int. Cl.[3] ..... H01H 61/02

[52] U.S. Cl. ..... 337/100; 337/113

[58] Field of Search ..... 337/100, 102, 107, 112, 337/113, 380

[56] References Cited

U.S. PATENT DOCUMENTS 1,621,023 3/1927 Newell ..... 337/100

3,474,372 10/1969 Davenport et al. ..... 337/100 X 3,550,055 12/1970 Grover ..... 337/100

*Primary Examiner*—George Harris

*Attorney, Agent, or Firm*—Oldham, Oldham, Hudak & Weber Co.

[57] ABSTRACT

An ambient compensated motor protector comprising a case having at least one initially open end and an assembly of superimposed members positioned in an insulation sleeve compressed in and sealing the open end of the case, the members including a bimetal strip extending into the case as a cantilever, a heater strip connected only to the free end of the bimetal strip, and a pair of insulation strips, one on each surface of the heater strip, at the sealed end of the case, to insulate the heater strip and bimetal strip from each other at that area of the motor protector.

7 Claims, 6 Drawing Figures

AMBIENT COMPENSATED MOTOR PROTECTOR

BACKGROUND ART

Heretofore, there have been many different types of motor protectors made in large quantities, and a number of different designs of these motor protectors have been provided. In use, these motor protectors must operate at predetermined temperatures for circuit opening and closing action, and they must remain operative and functioning in accordance with the desired calibration under widely variable ambient temperatures. Furthermore, in small electrical control instruments of this type, very high quality standards are required and very severe test conditions are set-up for these articles by safety testing labs, such as Underwriters Laboratory, Inc. The controls must open the controlled circuit, for example, in less than 45 seconds at 180° F., 76° F., and at −20° F., and in more than 1½ seconds. A constant current motor is used in such test. The current drawn however, by such motor is maximum when started. The current reduces gradually for about 40 seconds and then stabilizes.

In other prior constructions, bimetal strips have been wound with wire when the wire is a heater to accelerate bimetal action. This type of a heater is costly to assemble and it presents electrical insulation problems.

DISCLOSURE OF INVENTION

The general object of the present invention is to provide an improved, reliable ambient temperature compensated motor protector that is made from known parts assembled in an improved manner for effective circuit control under widely different temperature conditions.

Another object of the invention is to provide a motor protector utilizing a heater strip therein, and wherein insulating strips and tapes are provided in a new relation with a plurality of superimposed bimetal strips and heater strips within the protector for the temperature-sensitive control action desired for electrical circuits.

Another object of the invention is to provide a motor protector made from relatively known materials, but which materials are assembled in a novel and improved manner, and provide an effective protection action over widely varied temperature conditions.

The foregoing and other objects and advantages of the invention will be made more apparent as the specification proceeds, are achieved by: a motor protector comprising a case having an initially open end and a closed end, a bimetal strip extending into said case as a cantilever, contact means on said case and strip for operative engagement, a high resistance heater strip secured to the free end of said bimetal strip and extending out of the open end of said case, insulation strips on both surfaces of said heater strip at the open end of said case, a plastic insulation tape encompassing said bimetal strip, heater strips and insulation strips, and an insulation sleeve means encompassing said insulation tape and members therein and positioned at the initially open end of said case, which end has been sealed about said insulation sleeve means and the tape and strips therein.

BRIEF DESCRIPTION OF DRAWINGS

Reference now is particularly made to the accompanying drawings, wherein.

When referring to corresponding members shown in the drawings and referred to in the specification, corresponding numerals are used to facilitate comparison therebetween.

BEST MODE FOR CARRYING OUT THE INVENTION

Figure 1:
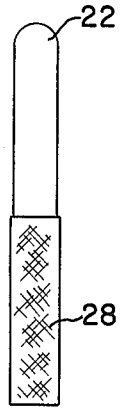
FIG. 1 is an elevation of a bimetal strip showing it at the first stage of assembly of the motor protector of the invention.

The present invention, as one embodiment thereof, relates to a motor protector that is ambient temperature compensated and which, as one embodiment, comprises a metal case having a initially open end and a closed end, an insulation sleeve and a plurality of superimposed members positioned within the sleeve and filling the open end of the case which is closed or compressed around such insulation sleeve and enclosed members; which motor protector is characterized by a bimetal strip extending as a cantilever into the metal case from its initially open end, a heater strip secured to the bimetal strip only at the free cantilevered end thereof, but extending out from the initially open end of the motor protector for connection to an electric circuit; a pair of insulation strips one on each of the face surfaces of the heater strip and, usually, an insulation tape is provided extending around the superimposed strips and making a unit thereof that is positioned within the insulation sleeve. The bimetal strip and heater strip are effectively electrically insulated from each other, and the heat flow to the case, or to or from the case from the heater strip is substantially blocked or prevented by an insulation strip on a surface of the heater strip adjacent the case. The insulation strip and insulation tape usually only extend a portion of the length of the heater strip and bimetal strip from the initially open end of the case. The insulation sleeve extends into the case a short distance with the bimetal strip and heater strip extending therebeyond internally of the case.

Reference now is particularly made to the details of the structure shown in the accompanying drawings, and an ambient temperature compensated motor protector is indicated as a whole by the numeral 10. This motor protector includes a metal case 12 and, in this particular instance, it is shown with one closed end 14 and one initially open end 16. However, in the manufacture of the motor protector 10, the initially open end 16 of the case has been crimped or compressed around an assembly of control members positioned within the case for operatively controlling the functioning and action thereof. Thus, an insulation sleeve 18, which is of conventional construction, and may for example, comprise a woven resin impregnated glass fiber member which is sealed by compression of the case at the end of the case and extends externally thereof, and also internally of the case, from the initially open end 16 thereof.

Figure 2:
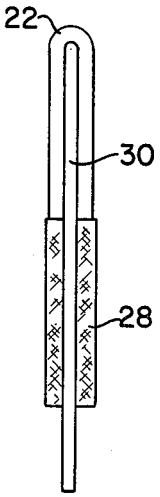
FIG. 2 shows the next step of assembly of the motor protector.
Figure 3:
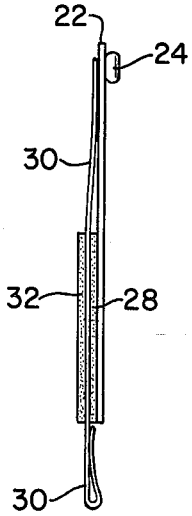
FIG. 3 shows the following step of adding an insulation strip to the assembly of FIG. 2.
Figure 4:
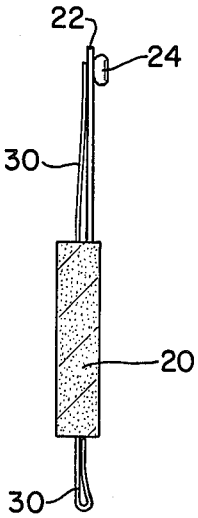
FIG. 4 shows the provision of an insulation tape around the superimposed members of FIG. 3.
Figure 5:
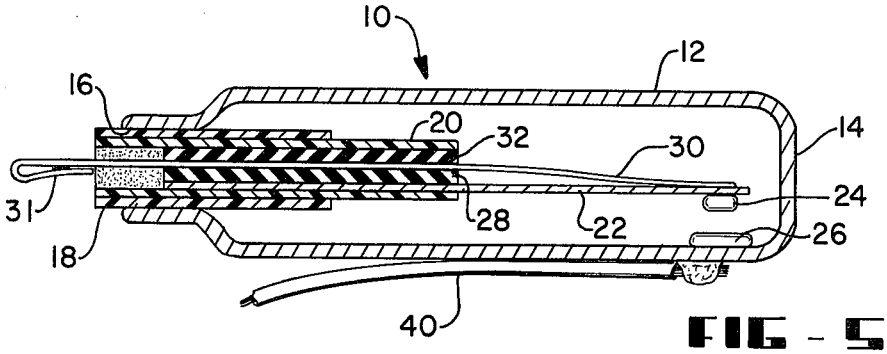
FIG. 5 is an enlarged longitudinal section of a motor protector of the invention.
Figure 6:
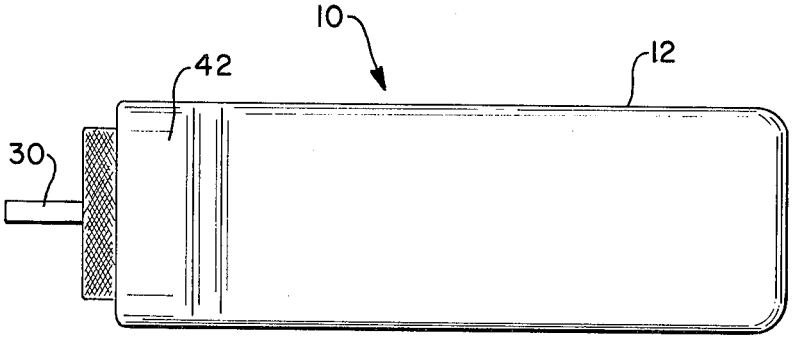
FIG. 6 is a plan view of the motor protector of the invention as assembled.

An assembly of operative members are positioned within the sleeve 18 and in this particular embodiment of the invention I prefer to utilize an insulating tape or equivalent insulation sleeve 20 that has one or more convolutions to secure a plurality of members in superimposed relation. This insulation tape 20, which usually is made from a conventional material such as teflon engages and encloses an assembly of a conventional bimetal strip 22. This strip 22 extends into the case as a cantilever and has a free end internally of the case that has a contact 24 thereon, which contact usually is facing downwardly and is adapted to engage with an associated contact 26 suitably secured, soldered or welded to the metal case 12 in operative association with the contact 24. Immediately above the bimetal strip 22 in its assembly in the sleeve 18 is an insulation strip or layer 28 that only extends a portion of the length of the cantilever bimetal strip and this obtains balanced heat transfer between heat conduction through the strip 28 and direct radiation from a relatively narrow heater strip 30 that is next vertically above the insulation strip 28 and extends the length of the bimetal. This heater strip 30 is made from a special ultra-high resistance Nichrome-resistance heater metal ribbon adapted to provide heat within the motor protector for control action. A second insulation strip or layer 32 is positioned above the heater strip 30 and both these insulation strips 28 and 32 normally are of substantially the width of bimetal strip 22. The heater strip is narrow, somewhere in the vicinity of about one-third the width of the bimetal strip, see FIG. 2.

These insulation strips 28 and 32 have a plurality of functions, with the insulation strip 28 preventing electrical contact between the bimetal strip and the heater strip. The upper insulation strip 32 insulates and reduces heat flow to or from the heater strip in relation to the metal case 12, and prevents the temperature of the metal case 12 from interfering with the function and control action provided by flow of electrical current through the heater strip 30. The case 12 is, in effect, a heat sink member and its temperature varies relatively slowly, though the temperature within the motor protector and especially the temperature of the heater strip may vary widely and rapidly with different operating conditions.

The insulation tape 20 that extends around the assembly of these strips provides both a heat insulating and physical retention action.

The insulation strips 28 and 32 preferably are made from an asbestos insulation paper.

Obviously a lead 40 that connects to the case 14 may be welded thereto at any suitable spot.

In one test unit, the heater strip was 0.003" and 1/32" wide with a resistance of 5.85 ohms per foot. The heater strip could reach a brilliant orange color of 1500° F. at 3½ amps in one second. The heater strip resistance in the protector 10 was reduced from 0.7 ohm to 0.4 ohm by bending the free end of the strip 30 back a substantial part of its length, and welding it to itself, as shown at 31. The doubled back end of the heater wire may end at the case 12 or extend slightly into it. Such construction concentrates the resistance of the heater strip internally of the case where maximum heating is desired. The initial length of the heater strip is approximately 1" and the fold or bend back section is about $\theta$ long, or about 25 percent of the initial length of the strip. By such construction, the strip resistance is reduced and a low resistance device is obtained.

The case 12 is crimped at 42 at its initially open end to compress around the sleeve 18 and close and seal the case end 16.

The motor protector has desirable control properties over a wide temperature range. The unit can be assembled readily for efficient operation. Hence, the objects of the invention have been achieved.

While one complete embodiment of the invention has been disclosed herein, it will be appreciated that modification of this particular embodiment of the invention may be resorted to without departing from the scope of the invention.

What is claimed is:

1. A motor protector comprising a case having an initially open end and a closed end, a bimetal strip extending into said case as a cantilever, contact means on said case and strip for operative engagement, a high resistance heater strip secured to the free end of said bimetal strip and extending out of the open end of said case, insulation strips on both surfaces of said heater strip at the open end of said case, a plastic insulation tape encompassing said bimetal strip, heater strips and insulation strips, and an insulation sleeve means encompassing said insulation tape and members therein and positioned at the initially open end of said case, which end has been sealed about said insulation sleeve means and the tape and strips therein.

2. A motor protector comprising a conductive case having an initially open end and a closed end, a terminal connected to such case, an insulation sleeve and a plurality of superimposed members therein filling said open end, said members including a bimetal strip, a heater strip one end of which is connected to a terminal, an insulation strip between said bimetal strip and said heater strip, and an insulation tape extending around the superimposed strips.

3. A motor protector as in claim 2, and comprising said heater strip being narrower than said bimetal and insulation strips, said bimetal strip projecting into said case as a cantilever, and said insulation strips being shorter in length than said bimetal strip cantilever section.

4. A motor protector as in claim 3, where said heater strip protrudes beyond the open end of said case to provide a terminal and said heater strip is doubled back on itself for such exposed length, said heater strip being longer than said bimetal strip.

5. A motor protector as in claim 3, where said bimetal strip has a contact at the end thereof on one surface thereof and said heater strip is secured to said bimetal strip on the other surface thereof opposite said contact but is otherwise free from contact with said bimetal strip.

6. A motor protector as in claim 4, where said heater strip has an initially free end that is folded back on itself for a distance of about ¼ inch to reduce the resistance of said heater strip and its other end if bonded to the bimetal strip adjacent the closed end of said case.

7. A motor protector as in claim 1, where said bimetal strip is not connected in an operative circuit for the motor protector.

* * * * *